US009416919B2

(12) United States Patent
DeMars

(10) Patent No.: US 9,416,919 B2
(45) Date of Patent: Aug. 16, 2016

(54) COMPACT HAZARDOUS GAS LINE DISTRIBUTION ENABLING SYSTEM SINGLE POINT CONNECTIONS FOR MULTIPLE CHAMBERS

(71) Applicant: Applied Materials, Inc., Santa Clara, CA (US)

(72) Inventor: Dennis L. DeMars, Santa Clara, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 119 days.

(21) Appl. No.: 14/507,254

(22) Filed: Oct. 6, 2014

(65) Prior Publication Data

US 2015/0102512 A1 Apr. 16, 2015

Related U.S. Application Data

(60) Provisional application No. 61/889,875, filed on Oct. 11, 2013.

(51) Int. Cl.

| | |
|---|---|
| ***F17D 1/04*** | (2006.01) |
| ***F17D 1/065*** | (2006.01) |
| ***F17D 3/01*** | (2006.01) |

(52) U.S. Cl.

CPC *F17D 1/04* (2013.01); *F17D 1/065* (2013.01); *F17D 3/01* (2013.01); *Y10T 137/0402* (2015.04); *Y10T 137/8326* (2015.04); *Y10T 137/86083* (2015.04)

(58) Field of Classification Search

CPC ..... B01D 47/00; F17D 1/04; F17D 1/065; F17D 3/01; Y10T 137/0402; Y10T 137/8326; Y10T 137/86083

USPC ..... 261/21, 22, 23.1, 75; 137/15.01, 557, 137/565.23

See application file for complete search history.

(56) References Cited

U.S. PATENT DOCUMENTS 5,359,787 A * 11/1994 Mostowy, Jr. ..... C23C 16/4402 34/343
6,520,203 B2 * 2/2003 Kitamura ..... F16K 11/083 137/240

(Continued)

FOREIGN PATENT DOCUMENTS

KR 2000-0055261 A 9/2000
KR 2007-0045529 A 5/2007

OTHER PUBLICATIONS

PCT Notification of Transmittal of the International Search Report and the Written Opinion of the International Searching Authority for International Application No. PCT/US2014/059292 dated Jan. 16, 2015; 9 total pages.

*Primary Examiner* — Charles Bushey
(74) *Attorney, Agent, or Firm* — Patterson & Sheridan, LLP

(57) ABSTRACT

A system and method for safely enabling the delivery of at least one gas line to at least one point of use in a facility by using a vacuum system and a gas delivery system wherein the gas delivery system is housed within the vacuum system is disclosed herein. An interior volume of a conduit containing therein at least one gas line is maintained at reduced pressure as one end of the gas line connects to a gas source and another end of the gas line connects to a point of use. By using a conduit to enclose the individual gas lines and using a single feed line for each gas, the embodiments disclosed herein reduce the number of individual gas lines that need to be run through a facility.

20 Claims, 5 Drawing Sheets

(56) References Cited

U.S. PATENT DOCUMENTS 8,623,141 B2 * 1/2014 Chang ..... F16K 51/02 118/683
2002/0179156 A1 * 12/2002 Smith ..... F17C 7/04 137/565.23
2003/0178094 A1 9/2003 Ageheim et al.
2005/0011449 A1 1/2005 Li et al.
2005/0034767 A1 * 2/2005 Reimer ..... H01L 21/67017 137/565.23
2008/0124463 A1 * 5/2008 Bour ..... C23C 16/45514 427/255.28
2009/0013930 A1 1/2009 Reinhold et al.

* cited by examiner

COMPACT HAZARDOUS GAS LINE DISTRIBUTION ENABLING SYSTEM SINGLE POINT CONNECTIONS FOR MULTIPLE CHAMBERS

CROSS-REFERENCE TO RELATED APPLICATIONS

This application claims benefit of U.S. Provisional Application Ser. No. 61/889,875, filed Oct. 11, 2013, of which is incorporated by reference in its entirety.

FIELD

Embodiments described herein generally relate to a gas line distribution system having single point connections for multiple chambers.

BACKGROUND

Semiconductor fabrication plants (FABs) and other research, industrial, and medical operations require the use of a variety gases. Gas lines carry the required gases to their points of use. Safety codes require that if gas lines carrying hazardous gases use fittings, the fittings must be located inside an exhausted enclosure. Safety codes also require a high exhaust flow through the exhausted enclosure, which causes the size of the exhausted enclosure to become impractically large and take up valuable working space.

Exhausted enclosures can be avoided if fittings are not used, such as if an all-welded line system is used. All-welded line systems maintain safety and security like exhausted enclosures, but all-welded line systems involve an extra level of complexity since the welded lines need to be fabricated section-by-section within the facility. All-welded line systems are also extremely expensive and take a long time to construct. Furthermore, many gas lines carrying hazardous gases need to have double containment, which greatly increases the cost and level of complexity. Therefore, all-welded line systems are not a satisfactory solution.

The cost of running an individual gas line using current methods is high. Facilities often require a large number of gas lines, which quickly amplifies the total cost of running gas lines. For example, multiple processing chambers within a FAB may each require the same twenty to thirty gases to carry out their operations. Using conventional methods, twenty to thirty individual gas lines would need to be run to each of the multiple processing chambers. In that common situation, the cost of providing gas lines to FAB equipment rapidly becomes extraordinarily expensive. As the complexity of a FAB or other facility continues to increase, so will the cost of providing the required gas lines.

As the foregoing illustrates, what is needed in the art is a safe, inexpensive, and convenient method for delivering a plurality of gas lines to different points of use within a FAB or other research, industrial, or medical facility.

SUMMARY

Embodiments disclosed herein use a vacuum source to cost-effectively and safely enable the delivery of at least one gas line contained within a vacuum conduit to at least one point of use. More specifically, embodiments disclosed herein include a vacuum gas delivery system. A vacuum gas delivery system includes a vacuum system and a gas delivery system wherein the gas delivery system is housed within the vacuum system. In an exemplary embodiment, a vacuum source is used to safely deliver the same one or more gas lines to each of one or more processing chambers within a FAB by maintaining a vacuum conduit that surrounds the individual gas lines at less than atmospheric pressure as the gas lines travel through the FAB or under the FAB floor. Embodiments allow the delivery of each gas to each chamber using a single feed gas line for each gas.

A method is disclosed for safely enabling the delivery of at least one individual gas line to at least one point of use in a facility comprising connecting a first vacuum conduit to a vacuum source, wherein the vacuum conduit comprises a conduit and at least one individual gas line contained therein, and the exterior of the at least one individual gas line is exposed to less than atmospheric pressure; and connecting each of the at least one individual gas lines to a point of use while maintaining the exterior of each of the at least one individual gas lines under less than atmospheric pressure.

A system is disclosed for safely enabling the delivery of at least one individual gas line to at least one point of use in a facility which includes a first vacuum conduit, the first vacuum conduit comprising a conduit and at least one individual gas line contained therein, and a vacuum source connected to the vacuum conduit so that the exterior of each of the at least one individual gas lines is maintained under less than atmospheric pressure.

A vacuum sealed junction box is disclosed which includes a junction box coupled to a first vacuum conduit and to a second vacuum conduit, wherein both the first and second vacuum conduits comprise a conduit and at least one individual gas line contained therein, wherein the conduits of the first and second vacuum conduits discontinue once inside the junction box, thereby exposing the at least one individual gas line, wherein each of the at least one individual gas lines splits once inside the junction box so that a first length of each of the at least one individual gas lines can connect to a point of use and a second length of each the at least one individual gas lines can become contained within the second vacuum conduit.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical applications or technical improvements over technologies found in the marketplace, or to enable others of ordinary skill in the art to understand the embodiments disclosed herein.

Embodiments disclosed herein use a vacuum source to cost-effectively and safely enable the delivery of at least one gas line contained within a vacuum conduit to at least one point of use. More specifically, embodiments disclosed herein include a vacuum gas delivery system. A vacuum gas delivery system includes a vacuum system and a gas delivery system wherein the gas delivery system is housed within the vacuum system. In an exemplary embodiment, a vacuum source is used to safely deliver the same one or more gas lines to each of one or more processing chambers within a FAB by maintaining a vacuum conduit that surrounds the individual gas lines at less than atmospheric pressure as the gas lines travel through the FAB or under the FAB floor. Embodiments allow the delivery of each gas to each chamber using a single feed gas line for each gas. A vacuum source can provide the same or better safety features as an exhausted enclosure, but the vacuum source can use a vacuum conduit with a much smaller diameter than the bulky exhaust ducts required by exhausted enclosures. By using a vacuum conduit to enclose the individual gas lines and using a single feed line for each gas, the embodiments disclosed herein reduce the number of individual gas lines that need to be run through a facility. As a result of the embodiments disclosed herein, the cost of running gas lines is greatly reduced, the loss of valuable work space due to the enlarged ducts of exhausted enclosures is eliminated, and the potential equipment down time associated with using all-welded systems is eliminated. Moreover, keeping the gas lines under vacuum protects the gas lines and allows the gas lines to have fittings for easy installation and repair.

Figure 1:
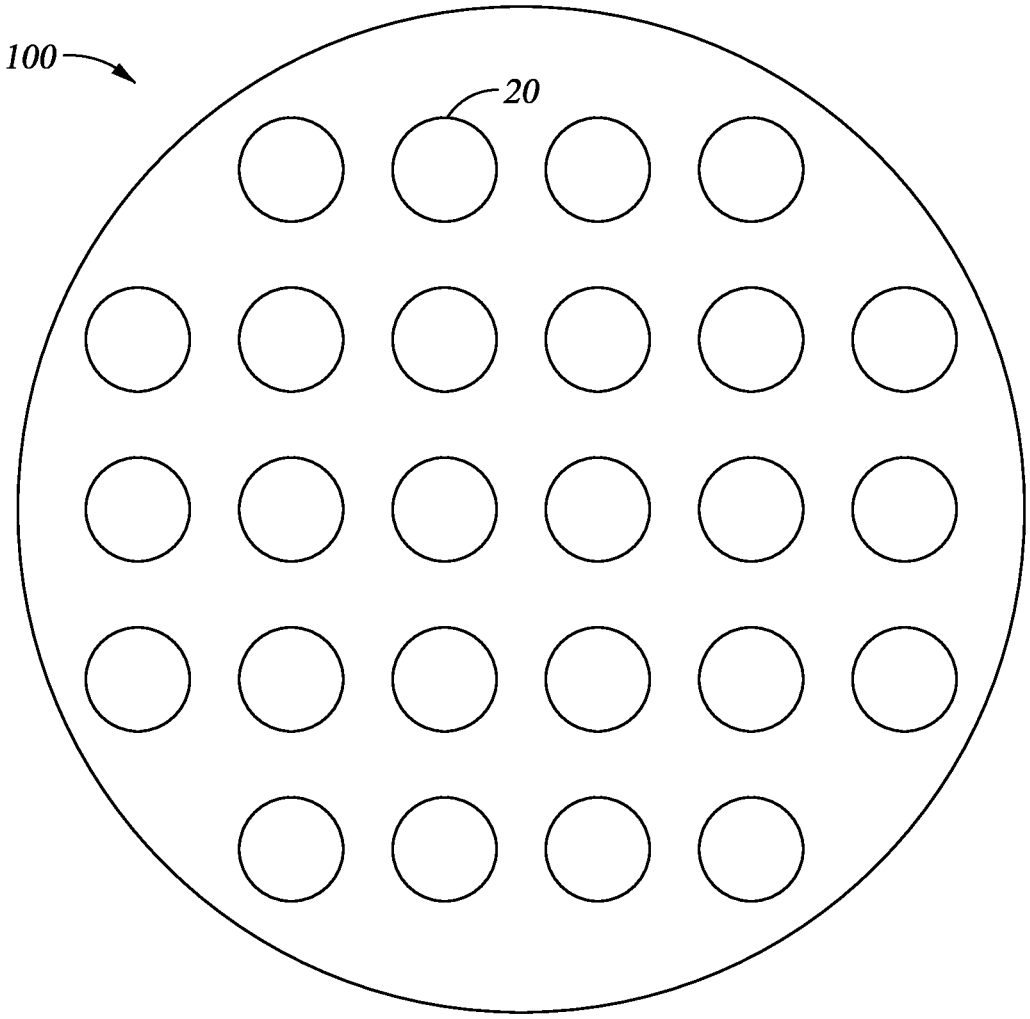
FIG. 1 illustrates a vacuum conduit having a plurality of individual gas lines housed therein according to an embodiment disclosed herein.

FIG. 1 illustrates a vacuum conduit 100 having a plurality of individual gas lines 20 housed therein according to an embodiment disclosed herein. The vacuum conduit 100 is shown as a round conduit, but can be any shape. The vacuum conduit 100 can be, for example, a pipe, sealed tray, or sealed trough, but in any event, the vacuum conduit 100 is an enclosure that can house gas lines 20 and maintain reduced pressure. The vacuum conduit 100 may be made of a material that is substantially impermeable to air, such as metal or a non-flammable composite material. Exemplary metals that may be used include aluminum, steel, stainless steel, and alloys thereof. Exemplary non-flammable composite materials that may be used include metal composites, carbon fiber, glass fiber and other fibrous composites. The vacuum conduit 100 functions as a vacuum enclosure so that when a vacuum source is applied to vacuum conduit 100, the volume within vacuum conduit 100 around the gas lines 20 is maintained at less than atmospheric pressure.

Each gas line 20 may carry a different gas or mixture of gases used in a FAB or other facility. Alternatively, some gases used in the FAB or other facility may be carried in more than one gas line 20. The gas lines 20 may vary in diameter, length, and composition material. Although vacuum conduit 100 is illustrated as having 26 gas lines contained therein, vacuum conduit 100 can have a different number of gas lines.

Figure 2:
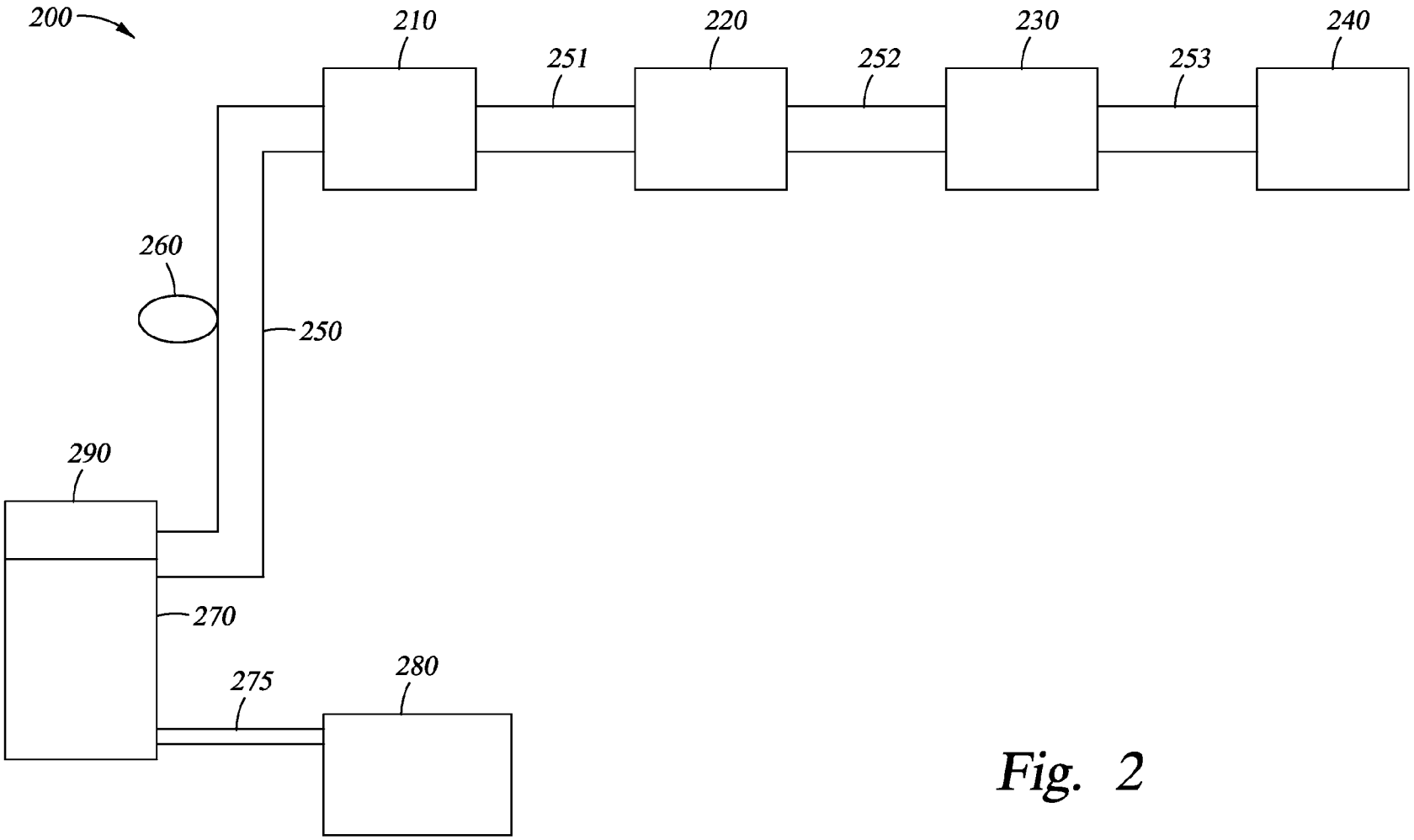
FIG. 2 illustrates a schematic of a vacuum gas delivery system within a facility according to an embodiment disclosed herein.

FIG. 2 illustrates vacuum gas delivery system 200, which generally includes a vacuum system and a gas delivery system wherein the gas delivery system is housed within the vacuum system. The vacuum system includes facility gas sources 290 coupled to vacuum conduit 250 and a vacuum source 270 connected on one end to process scrubber 280 and on another end to vacuum conduit 250, which couples to a first junction box 210 and communicates the reduced pressure environment created by vacuum source 270 to a series of junction boxes 210, 220, 230, and 240 and vacuum conduits 251, 252, and 253, wherein each vacuum conduit communicates the reduced pressure environment from one junction box to another junction box.

Vacuum source 270 may be a vacuum pump, such as a conventional roughing pump available in most facilities. The vacuum source reduces the pressure within the vacuum gas delivery system 200 to below atmospheric pressure. Vacuum conduit 250 sealingly couples the vacuum source 270 to a first junction box 210. A junction box, as discussed in more detail below, is capable of holding a vacuum and contains gas lines 20 and gas fittings to enable delivery of gases to a chamber, for example, while also continuing to deliver gases to another junction box. The junction box is accessible to make the necessary connections on the gas lines 20, but is maintained under less than atmospheric pressure during normal operation. One or more junction boxes may be coupled to vacuum conduit 250 between the facility gas sources 290 and the first junction box 210 so as to enable the gas lines 20 to be connected with fittings.

A vacuum conduit 251 couples the first junction box 210 to a second junction box 220. A vacuum conduit 252 couples the second junction box 220 to a third junction box 230. A vacuum conduit 253 couples the third junction box 230 to a fourth junction box 240. Since each junction box and each vacuum conduit are capable of holding a vacuum, the vacuum source 270 can maintain the entire system of junction boxes and vacuum conduits at less than atmospheric pressure.

Process scrubber 280 may be coupled to vacuum source 270 through a process scrubber conduit 275. A process scrubber can scrub any hazardous gases that enter the vacuum source 270, thereby enabling proper disposal or recycle of the exhausted gases.

Safety switch 260 may be connected to the vacuum system, such as at vacuum conduit 250. While the vacuum system is running, a certain reduced pressure is maintained within the system. Safety switch 260 contains a pressure sensor, and if the sensor detects an increase in pressure, the switch will determine that a gas leak is present. For example, safety switch 260 could be a ½ atm pressure switch. The safety switch 260 is configured to communicate with the facility gas sources 290. If the safety switch detects an increase in pressure, the safety switch will send a signal to the facility gas sources 290 ordering the facility gas sources 290 to be turned off.

The facility gas sources 290 include a plurality of access points for the various gases used within the FAB or other facility. Facility gas sources 290 may share a housing with vacuum source 270. Vacuum conduit 250 sealingly couples to the facility gas sources 290. Gas lines 20 contained within vacuum conduit 250 connect on one end to the access points of the facility gas sources 290 and may connect on the other end to gas panels associated with junction boxes 210, 220, 230, and 240. The gas lines 20 between the gas sources and the junction boxes may have a larger diameter than the gas lines connected between the junction boxes and the gas panels. As shown, the facility gas sources 290 are housed within the same housing as vacuum source 270, but the facility gas sources 290 may be located elsewhere in the facility.

Junction boxes 210, 220, 230, and 240 are vacuum sealed boxes wherein gas lines 20 may be split so that one gas line 20 may travel to a point of use associated with that individual junction box and another gas line 20 may travel to another junction box, to the facility gas sources 290, or to another location. In some instances, the gas line may not need to be split within a junction box, such as if the junction box is the last junction box in a chain of junction boxes or a particular gas is not needed at other junction boxes. Each junction box may be connected to a point of use, such as a gas panel serving a process chamber. A junction box serves to link a series of points of use to the same gas lines 20 while maintaining the gas lines 20 safely under vacuum.

In the representative example shown in FIG. 2, the vacuum conduit 250 sealingly couples to a point of access to the facility gas sources 290, and the point of access to facility gas sources 290 is coupled to at least some of the gas lines contained within vacuum conduit 250. Vacuum conduit 250 also sealingly couples to first junction box 210. Once inside first junction box 210, the gas lines may be split so that one gas line may travel towards a point of use, such as to a gas panel serving a processing chamber, and a second gas line may enter vacuum conduit 251. Vacuum conduit 251 sealingly couples on one end to first junction box 210 and on another end to second junction box 220. Once inside second junction box 220, the gas lines may split so that one gas line may travel towards a point of use, such as to a gas panel serving a second processing chamber, and a second gas line may enter vacuum conduit 252. Vacuum conduit 252 sealingly couples on one end to second junction box 220 and on another end to a third junction box 230. Once inside third junction box 230, each gas line may split so that one gas line may travel towards a point of use, such as to a gas panel serving a third processing chamber, and a second gas line may enter vacuum conduit 253. Vacuum conduit 253 may sealingly couple on one end to third junction box 230 and sealingly couple on another end to fourth junction box 240. Once inside fourth junction box 240, each gas line may travel towards a gas panel associated with a point of use, such as to a fourth processing chamber. Vacuum gas delivery system 200 is illustrated using four junction boxes, however, systems can be created that use a different number of junction boxes and points of use, e.g., gas panels serving processing chambers.

Figure 3A:
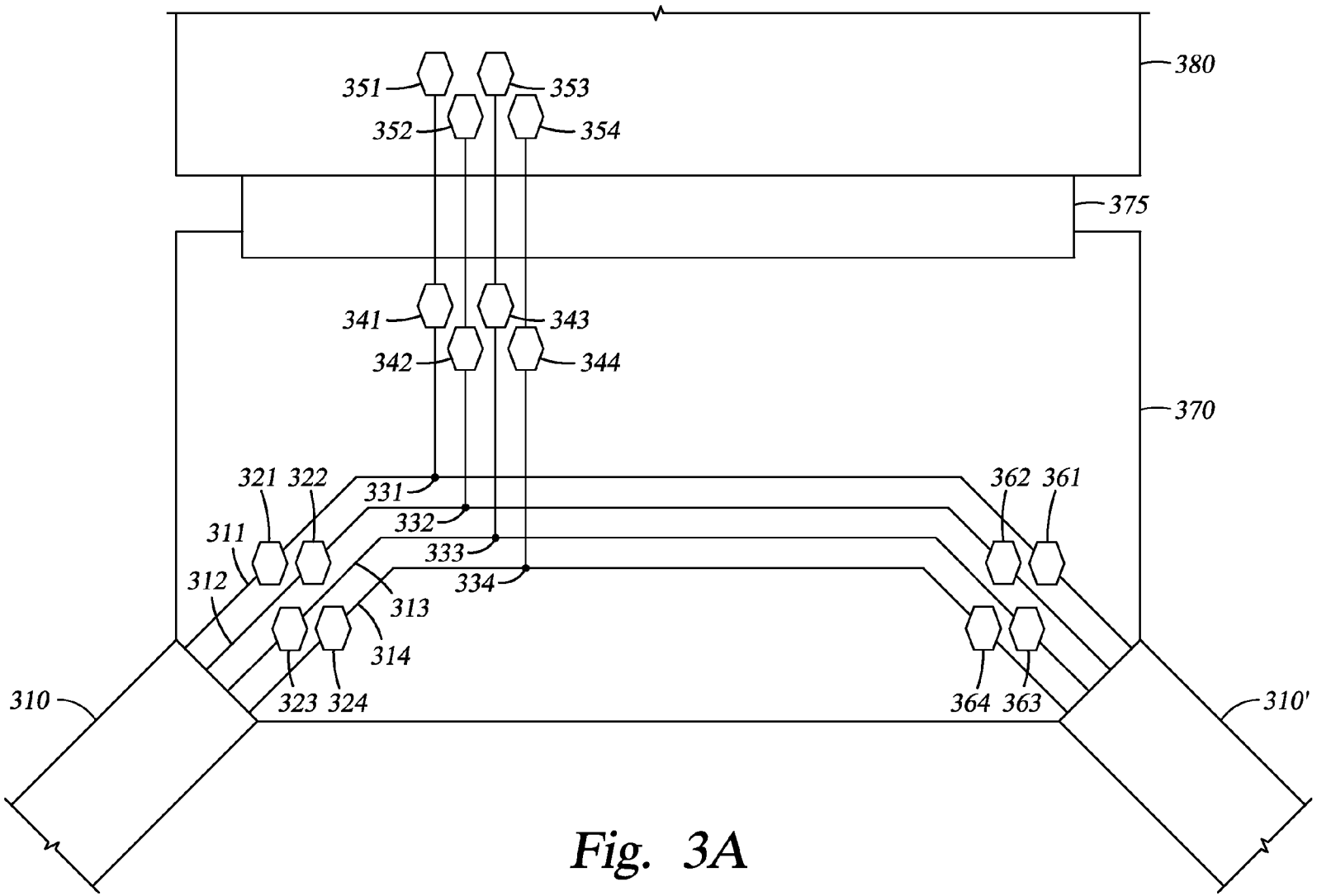
FIG. 3A illustrates a top view of a junction box and gas panel exhaust duct of a gas delivery system according to an embodiment disclosed herein.

FIG. 3A is a top view of a junction box 370 and gas panel exhaust duct 380 within a FAB. A first vacuum conduit 310 sealingly couples with junction box 370 wherein gas lines 311, 312, 313, and 314 split so that one gas line can travel through a welded bulkhead 375 and into a gas panel exhaust duct 380 and a second gas line may travel into a second vacuum conduit 310,' which is also sealingly coupled to junction box 370.

Once inside junction box 370, gas lines 311, 312, 313, and 314 may connect to a first fitting, shown as 321, 322, 323, and 324. The first fitting may be a metal fitting, such as a metal union fitting. Conventional fittings are available from Swagelok, e.g., VCR fittings. Gas lines 311, 312, 313, and 314 may connect to a splitter, shown as 331, 332, 333, and 334, located along each gas line. A first gas line from each of gas lines 311, 312, 313, and 314 that leaves the splitters 331, 332, 333, and 334, respectively, may travel towards gas panel exhaust duct 380. A second fitting, shown as 341, 342, 343, and 344, may be coupled to each gas line that travels towards the gas panel exhaust duct 380. The second fitting may be a metal union fitting, with or without an integrated flow restrictor. The second fitting may connect to each gas line before the gas line reaches the welded bulkhead 375. The first gas line may travel through the welded bulkhead 375 and into gas panel exhaust duct 380. The welded bulkhead 375 forms a vacuum-tight connection between the junction box 370 and the gas panel exhaust duct 380. Once the first gas line is within gas panel exhaust duct 380, each gas line may connect with a fitting, shown as 351, 352, 353, and 354, that may connect each gas line to the gas panel associated with junction box 370. The gas panel may be the point of use of each gas line and may serve a processing chamber.

A second gas line that leaves each splitter (331, 332, 333, and 334) may extend towards second vacuum conduit 310'. Each gas line may couple to a third fitting (shown as 361, 362, 363, and 364). The third fitting may be a metal fitting, such as a metal union fitting. Each gas line may then travel into the second vacuum conduit 310' and exit junction box 370.

Although first vacuum conduit 310 and second vacuum conduit 310' are depicted as containing four gas lines, first vacuum conduit 310 and second vacuum conduit 310' can contain a different number of gas lines. Each gas line that enters junction box 370 through first vacuum conduit 310 may exit the junction box 370 through second vacuum conduit 310'. Alternatively, some gas lines that enter junction box 370 through first vacuum conduit 310 may terminate in junction box 370.

Figure 3B:
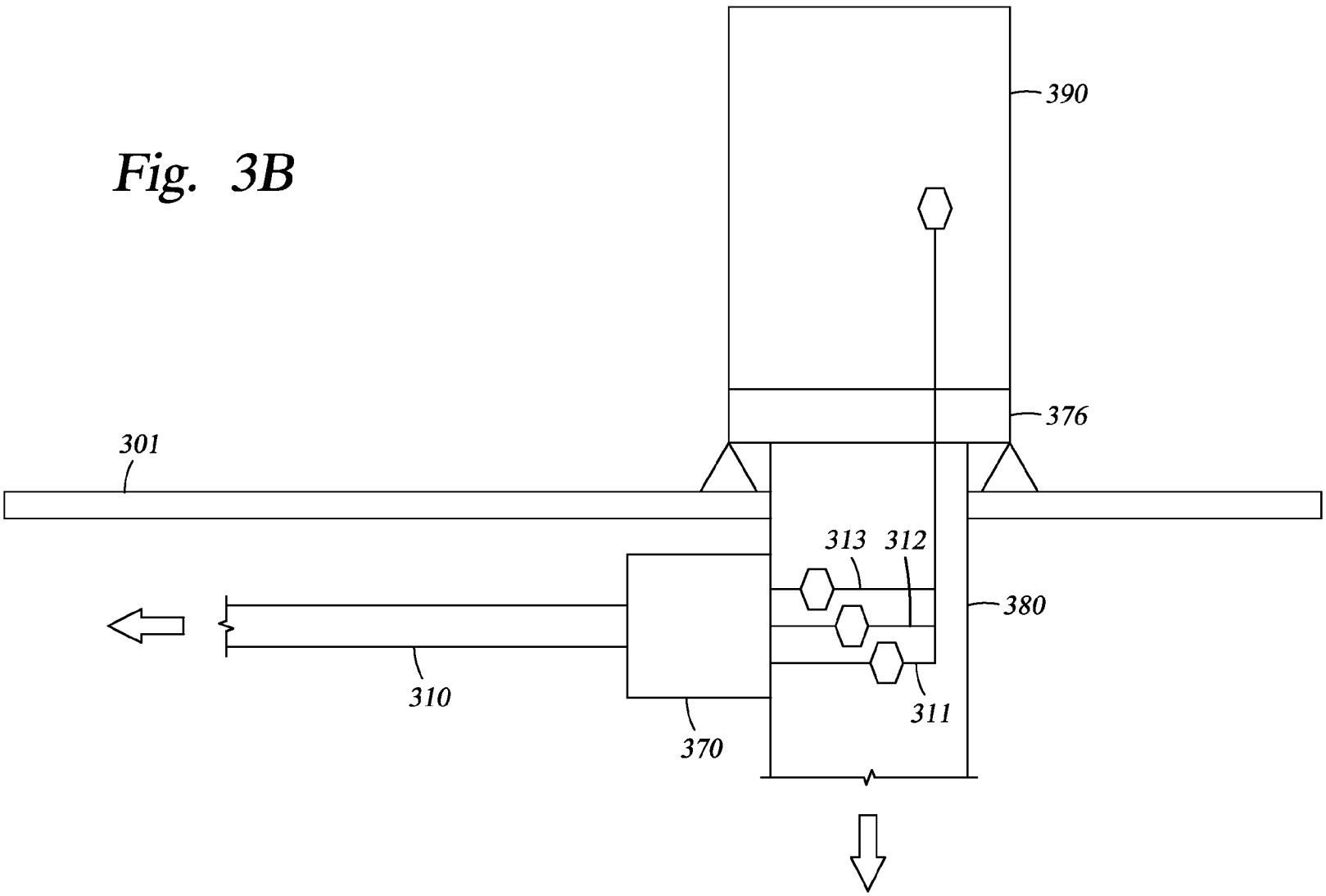
FIG. 3B illustrates a side view of aspects of a vacuum gas delivery system according to an embodiment disclosed herein.

FIG. 3B is a side view of the vacuum gas delivery system 200 connected to a chamber system within a FAB. As shown, FIG. 3B depicts vacuum conduit 310, junction box 370, individual gas lines 311, 312, and 313, a gas panel exhaust duct 380, and a gas panel 390. Vacuum conduit 310 sealingly couples to junction box 370. Gas lines 311, 312, and 313 exit junction box 370, enter gas panel exhaust duct 380, and then extend across welded bulkhead 376 and into gas panel 390. While not shown, gas lines 311, 312, and 313 can continue to other junction boxes downstream or upstream of the junction box shown. The vacuum gas delivery system may be located below the floor 301 of a facility, such as a FAB. Alternatively, vacuum gas delivery system may be located above the processing equipment.

Figure 4:
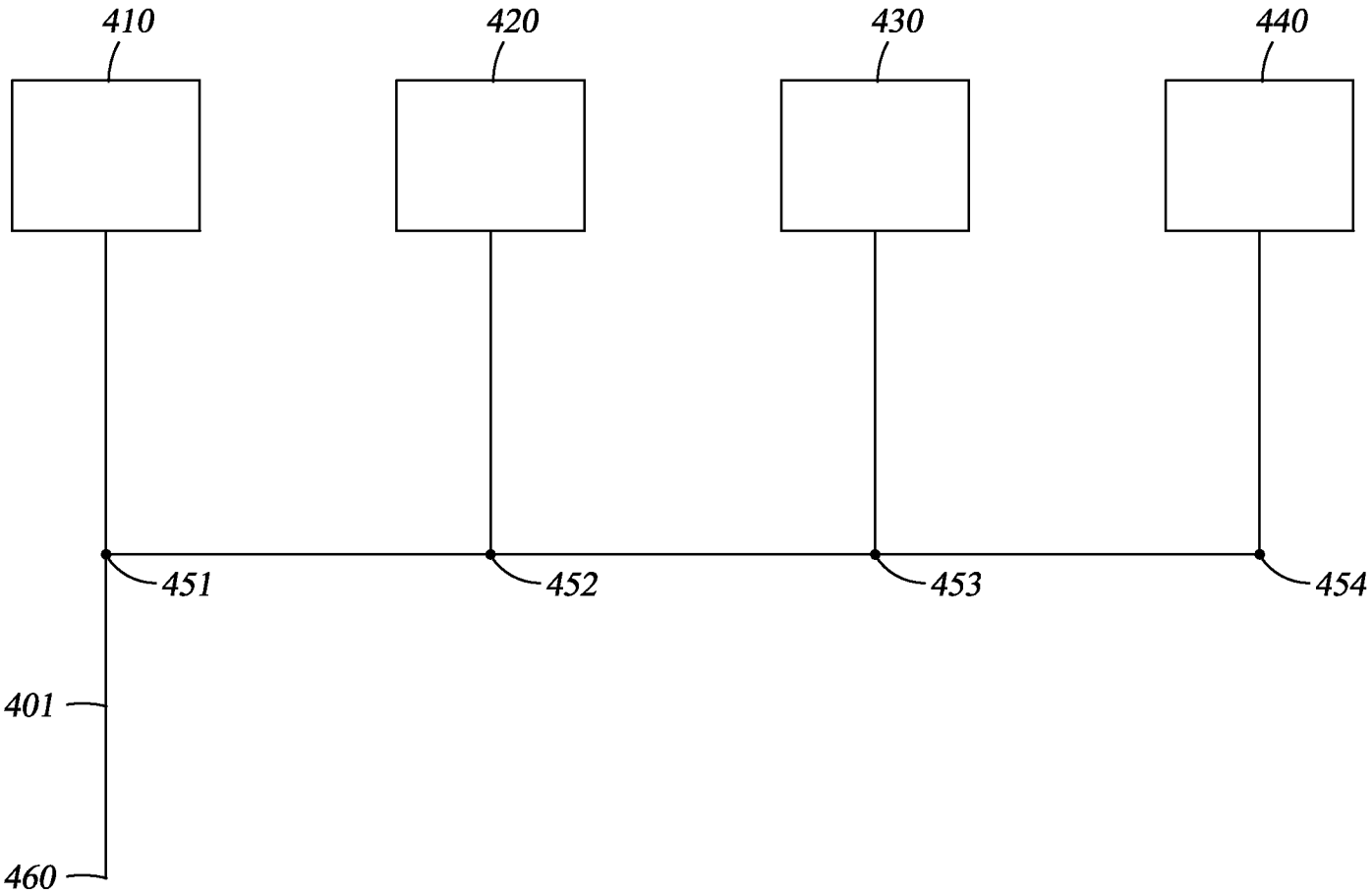
FIG. 4 is a schematic of a gas line of a vacuum gas delivery system according to an embodiment disclosed herein.

FIG. 4 is a schematic of a single gas line within vacuum gas delivery system 200, according to an embodiment disclosed herein. Single gas line 401 is contained within vacuum gas delivery system 200 and is connected on one end to a facility gas source 460 and is also connected to points of use 410, 420, 430, and 440. When vacuum gas delivery system 200 is running, the exterior of gas line 401 is exposed to less than atmospheric pressure. The points of use for single gas line 401 can be gas panels that serve processing chambers. Intersections 451, 452, 453, and 454 indicate points along vacuum gas delivery system 200 where gas line 401 is within a junction box.

Embodiments disclosed herein include a vacuum gas delivery system. A vacuum gas delivery system includes a vacuum system and a gas delivery system wherein the gas system is housed within the vacuum system. In an exemplary embodiment, a vacuum source is used to safely deliver the same twenty or more gas lines to each of four or more processing chambers within a FAB by maintaining a conduit that surrounds the gas lines at less than atmospheric pressure as the gas lines travel through the FAB or under the FAB floor. A vacuum source can provide the same or better safety features as an exhausted enclosure, but the vacuum source can use a vacuum conduit with a much smaller diameter than the bulky exhaust ducts required by exhausted enclosures.

By using a vacuum source connected to a vacuum system enclosing individual gas lines, the embodiments disclosed herein reduce the number of individual gas lines that need to be run through a facility. As a result of the embodiments disclosed herein, the cost of running gas lines is greatly reduced, the loss of valuable work space due to the enlarged ducts of exhausted enclosures is eliminated, and the potential equipment down time associated with using all-welded systems is also eliminated. Moreover, keeping the gas lines under vacuum protects the gas lines and allows the gas lines to have fittings for easy installation and repair.

While the foregoing is directed to embodiments of the present invention, other and further embodiments of the invention may be devised without departing from the basic scope thereof, and the scope thereof is determined by the claims that follow.

The invention claimed is:

1. A method for safely enabling the delivery of a plurality of gas lines to at least one point of use in a facility comprising:

connecting a first vacuum conduit to a vacuum source, wherein the vacuum conduit comprises a conduit and a plurality of individual gas lines contained therein, and wherein an exterior of each of the plurality of individual gas lines is exposed to less than atmospheric pressure; and connecting each of the plurality of individual gas lines to a point of use while maintaining the exterior of each of the plurality of individual gas lines under less than atmospheric pressure.

2. The method of claim 1, further comprising:

connecting the first vacuum conduit to a junction box wherein the conduit of the first vacuum conduit discontinues exposing the plurality of individual gas lines and wherein each of the plurality of individual gas lines travel to the point of use.

3. The method of claim 2, wherein the first vacuum conduit is located under a facility floor.

4. The method claim 2, wherein at least one point of use of at least one of the plurality of individual gas lines is a gas panel.

5. The method of claim 2, further comprising:

splitting each of the plurality of individual gas lines within the first junction box so that a first length of each of the plurality of individual gas lines travels to the point of use and a second length of each of the plurality of individual gas lines travels inside a second vacuum conduit coupled to the first junction box.

6. The method of claim 5, further comprising:

connecting the second vacuum conduit to a second junction box.

7. The method of claim 5, further comprising:

connecting a safety switch to a vacuum conduit located between the first vacuum conduit and the vacuum source.

8. The method of claim 5, further comprising:

connecting a process scrubber to the vacuum source.

9. A system for safely enabling the delivery of a plurality of gas lines to at least one point of use in a facility comprising:

a first vacuum conduit, the first vacuum conduit comprising a conduit and a plurality of individual gas lines contained therein; and a vacuum source connected to the vacuum conduit so that an exterior of each of the plurality of individual gas lines is maintained under less than atmospheric pressure.

10. The system of claim 9, further comprising:

a safety switch connected to a vacuum conduit located between the first vacuum conduit and the vacuum source.

11. The system of claim 9, further comprising:

a process scrubber connected to the vacuum source.

12. The system of claim 9, wherein at least one point of use of at least one of the plurality of individual gas lines is a gas panel.

13. The system of claim 9, further comprising:

a first junction box coupled to the first vacuum conduit and positioned between the first vacuum conduit and the point of use;

wherein the conduit of the first vacuum conduit discontinues upon entering the first junction box, exposing the plurality of individual gas lines;

and wherein the plurality of individual gas lines travel toward their points of use.

14. The system of claim 13, further comprising:

a splitter within the first junction box and coupled to each of the plurality of individual gas lines, the splitter forming a first length of each of the plurality of individual gas lines that travels towards each point of use and a second length of each of the plurality of individual gas lines that travels inside a second vacuum conduit coupled to the first junction box.

15. The system of claim 14, further comprising:

a second junction box coupled to the second vacuum conduit.

16. The system of claim 15, wherein either the first junction box or second box is coupled to its respective point of use by a welded bulkhead.

17. The system of claim 15, wherein either the first vacuum conduit or second vacuum conduit is located under a facility floor.

18. A vacuum sealed junction box comprising:

a junction box coupled to a first vacuum conduit and to a second vacuum conduit;

wherein both the first and second vacuum conduits comprise a conduit and a plurality of individual gas lines contained therein;

wherein the conduits of the first and second vacuum conduits discontinue once inside the junction box, thereby exposing the plurality of individual gas lines;

wherein each of the individual gas lines splits once inside the junction box so that a first length of the individual gas line can connect to a point of use and a second length of the individual gas line can become contained within the second vacuum conduit.

19. The junction box of claim 18, wherein at least one point of use of at least one of the plurality of individual gas lines is a gas panel.

20. The junction box of claim 19, wherein the gas panel is coupled to the junction box by a welded bulkhead.

* * * * *